US010559929B2

(12) United States Patent
Pickel et al.

(10) Patent No.: US 10,559,929 B2
(45) Date of Patent: Feb. 11, 2020

(54) ELECTRICAL CONNECTOR SYSTEM HAVING A PCB CONNECTOR FOOTPRINT

(71) Applicant: TE CONNECTIVITY CORPORATION, Berwyn, PA (US)

(72) Inventors: Justin Dennis Pickel, Hummelstown, PA (US); Timothy Robert Minnick, Enola, PA (US); Arturo Pachon Munoz, Harrisburg, PA (US); Sean Patrick McCarthy, Palmyra, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/224,299

(22) Filed: Dec. 18, 2018

(65) Prior Publication Data

US 2019/0229472 A1 Jul. 25, 2019

Related U.S. Application Data

(60) Provisional application No. 62/621,764, filed on Jan. 25, 2018.

(51) Int. Cl.
*H01R 13/6587* (2011.01)
*H01R 12/73* (2011.01)
*H01R 13/6471* (2011.01)

(52) U.S. Cl.
CPC ..... *H01R 13/6587* (2013.01); *H01R 12/73* (2013.01); *H01R 13/6471* (2013.01)

(58) Field of Classification Search
CPC ..... H01R 13/6471; H01R 13/6587
USPC ..... 439/607.05, 607.09, 607.1, 607.11
See application file for complete search history.

(56) References Cited

U.S. PATENT DOCUMENTS 6,409,543 B1 * 6/2002 Astbury, Jr. ..... H01R 13/6587 439/607.07
6,471,548 B2 * 10/2002 Bertoncini ..... H01R 13/6585 439/607.1
6,506,076 B2 * 1/2003 Cohen ..... H01R 23/688 439/607.09
6,527,587 B1 * 3/2003 Ortega ..... H01R 13/6585 439/607.05
6,758,695 B2 * 7/2004 Pepe ..... H01R 4/2429 439/405
6,808,420 B2 * 10/2004 Whiteman, Jr. ... H01R 13/6587 439/108
6,899,566 B2 * 5/2005 Kline ..... H01R 13/514 439/108

(Continued)

*Primary Examiner* — Neil Abrams

(57) ABSTRACT

A printed circuit board (PCB) includes a substrate and a PCB connector footprint defined along a longitudinal axis and a lateral axis being subdivided into PCB column grouping footprints in columns parallel to the longitudinal axis. The PCB includes signal vias arranged in pairs along a signal pair axis. The pairs of signal vias are aligned in the columns parallel to the longitudinal axis and in rows parallel to the lateral axis. The signal pair axis is non-parallel to the lateral and longitudinal axes. The PCB includes ground vias with at least one ground via arranged between adjacent pairs of signal vias within the PCB column grouping footprints and at least one ground via is arranged between adjacent pairs of signal vias in adjacent PCB column grouping footprints. This orientation is to allow more spacing between the signal vias and some ground vias to enhance signal integrity.

20 Claims, 5 Drawing Sheets

(56) References Cited

U.S. PATENT DOCUMENTS 7,094,102 B2 * 8/2006 Cohen ..... H05K 1/14 439/607.08
7,207,807 B2 * 4/2007 Fogg ..... H01R 13/6461 439/65
7,604,502 B2 * 10/2009 Pan ..... H01R 23/688 439/607.08
7,762,843 B2 * 7/2010 Minich ..... H01R 24/30 439/607.05
7,789,705 B2 * 9/2010 Morgan ..... H01R 13/6477 439/607.05
8,183,466 B2 5/2012 Morlion et al.
8,382,524 B2 * 2/2013 Khilchenko ..... H01R 13/6616 439/620.09
8,430,691 B2 * 4/2013 Davis ..... H01R 13/6585 439/607.09
8,444,436 B1 * 5/2013 Cohen ..... H05K 1/115 439/607.08
8,579,636 B2 * 11/2013 Davis ..... H01R 12/7082 439/65
8,591,260 B2 * 11/2013 Davis ..... H01R 13/6586 439/607.55
8,628,356 B2 * 1/2014 Laurx ..... H01R 12/737 439/628
8,920,194 B2 * 12/2014 Minich ..... H01R 13/6471 439/607.05
8,992,253 B2 * 3/2015 McClellan ..... H01R 12/71 439/607.05
9,093,800 B2 * 7/2015 Laub ..... H01R 12/727
9,209,539 B2 * 12/2015 Herring ..... H04Q 1/15
9,257,778 B2 * 2/2016 Buck ..... H01R 13/516
9,281,579 B2 * 3/2016 Davis ..... H01R 9/24
9,331,407 B2 * 5/2016 Laurx ..... H01R 13/6587
9,515,429 B2 * 12/2016 De Geest ..... H01R 13/6585
9,570,857 B2 * 2/2017 Morgan ..... H01R 13/6585
9,620,876 B2 * 4/2017 Leibold ..... H01R 13/03
9,774,144 B2 * 9/2017 Cartier, Jr. ..... H01R 13/6585
9,831,608 B1 * 11/2017 Pickel ..... H01R 13/6471
9,923,309 B1 * 3/2018 Aizawa ..... H01R 13/6587
10,096,924 B2 * 10/2018 Trout ..... H01R 12/724
10,148,025 B1 * 12/2018 Trout ..... H01R 12/585
10,186,810 B2 * 1/2019 Morgan ..... H01R 13/6587
10,186,811 B1 * 1/2019 Trout ..... H01R 13/6588
10,431,936 B2 * 10/2019 Horning ..... H01R 13/6473
2006/0228912 A1 * 10/2006 Morlion ..... H01R 23/688 439/65
2018/0358751 A1 * 12/2018 Laurx ..... H01R 13/6587
2019/0229472 A1 * 7/2019 Pickel ..... H01R 13/6587

* cited by examiner

ELECTRICAL CONNECTOR SYSTEM HAVING A PCB CONNECTOR FOOTPRINT

CROSS REFERENCE TO RELATED APPLICATIONS

This application claims benefit to U.S. Provisional Application No. 62/621,764, filed Jan. 25, 2018, titled "ELECTRICAL CONNECTOR SYSTEM HAVING A PCB CONNECTOR FOOTPRINT", the subject matter of which is herein incorporated by reference in its entirety.

BACKGROUND OF THE INVENTION

The subject matter herein relates generally to electrical connector systems having PCB connector footprints for electrical connectors.

Some electrical systems utilize electrical connectors, such as header assemblies and receptacle assemblies, to interconnect two circuit boards, such as a motherboard and daughtercard. Some known electrical connectors include a housing holding signal contacts and ground shields providing electrical shielding for the signal contacts. The signal contacts and the ground shields include mounting portions, such as eye of the needle pins, terminated to the circuit board. The circuit board includes signal vias and ground vias to receive the mounting portions.

Circuit board layout and design is complicated, particularly for high density electrical connectors and on circuit boards having multiple components mounted thereto. It is desirable to reduce the number of layers in a circuit board to reduce costs of the circuit board. Routing of the traces is difficult in some circuit boards. Additionally, as the connectors become smaller, the footprints of the connectors are smaller providing less space on the circuit board for providing the vias and routing the traces.

A need remains for a PCB connector footprint and circuit layout for terminating high speed, high density electrical connectors.

BRIEF DESCRIPTION OF THE INVENTION

In one embodiment, a printed circuit board (PCB) is provided for an electrical connector having signal contacts and ground contacts extending from a mounting end of the electrical connector. The PCB includes a substrate having a plurality of layers and a connector surface configured to face the electrical connector and a PCB connector footprint on the connector surface defined below a footprint of the electrical connector. The PCB connector footprint is an area defined along a longitudinal axis and a lateral axis perpendicular to the longitudinal axis. The PCB connector footprint is subdivided into PCB column grouping footprints generally arranged in columns parallel to the longitudinal axis. The PCB includes signal vias at least partially through the substrate being arranged in pairs arranged along a signal pair axis with a plurality of pairs of signal vias in each PCB column grouping footprint and being non-parallel to the longitudinal axis. The pairs of signal vias are aligned in the corresponding columns parallel to the longitudinal axis and are arranged in corresponding rows parallel to the lateral axis. The signal pair axis is non-parallel to the lateral axis and is non-parallel to the longitudinal axis. The PCB includes ground vias at least partially through the substrate. The ground vias are arranged around each of the pairs of signal vias to provide electrical shielding around each of the pairs of signal vias. A least one ground via is arranged between adjacent pairs of signal vias within the PCB column grouping footprints and at least one ground via is arranged between adjacent pairs of signal vias in adjacent PCB column grouping footprints.

In another embodiment, an electrical connector system is provided including an electrical connector having a housing holding signal contacts and ground shields. The signal contacts are arranged in pairs carrying differential signals and have signal mounting portions extending from a mounting end of the housing. The ground shields have ground mounting portions extending from the mounting end of the housing. The electrical connector system includes a printed circuit board (PCB) including a substrate having a connector surface facing the electrical connector and a PCB connector footprint on the connector surface defined below a footprint of the electrical connector. The PCB connector footprint is an area defined along a longitudinal axis and a lateral axis perpendicular to the longitudinal axis. The PCB connector footprint is subdivided into PCB column grouping footprints. The PCB column grouping footprints are areas extending generally parallel to the longitudinal axis. The PCB includes signal vias arranged in pairs arranged along a corresponding signal pair axis receiving corresponding signal mounting portions. Pairs of signal vias are arranged in each PCB column grouping footprint. The signal pair axis is non-parallel to the longitudinal axis and is non-parallel to the lateral axis. The signal pair axis intersects the longitudinal axis at a greater angle than the signal pair axis intersects the lateral axis. The PCB includes ground vias arranged around each of the pairs of signal vias to provide electrical shielding around each of the pairs of signal vias. The ground vias receive corresponding ground mounting portions.

In a further embodiment, an electrical connector system is provided including an electrical connector having a housing including a base wall and shroud walls defining a cavity configured to receive a mating electrical connector. The base wall has signal channels and shield channels therethrough and a mounting end. The housing holds signal contacts in corresponding signal channels and holds ground shields in corresponding shield channels. The signal contacts are arranged in pairs carrying differential signals. The signal contacts have mating ends received in the cavity for mating with the mating electrical connector. The signal contacts have signal mounting portions extending from a mounting end of the housing. The ground shields have an end wall, a first side wall extending from a first edge of the end wall and a second side wall extending from a second edge of the end wall. The end wall, the first side wall and the second side wall form a shield pocket receiving a corresponding pair of the signal contacts and surrounding three sides of the corresponding pair of signal contacts to provide electrical shielding for the pair of signal contacts. The ground shields have ground mounting portions extending from the mounting end of the housing. The electrical connector system includes a printed circuit board (PCB) including a substrate having a connector surface facing the electrical connector and a PCB connector footprint on the connector surface defined below a footprint of the electrical connector. The PCB connector footprint is an area defined along a longitudinal axis and a lateral axis perpendicular to the longitudinal axis. The PCB connector footprint is subdivided into PCB column grouping footprints. The PCB column grouping footprints are areas extending generally parallel to the longitudinal axis. The PCB includes signal vias arranged in pairs arranged along a corresponding signal pair axis receiving corresponding signal mounting portions. Pairs of signal vias are arranged in each PCB column grouping footprint. The signal pair axis is non-parallel to the longitudinal axis and non-parallel to the lateral axis. The PCB includes ground vias arranged around each of the pairs of signal vias to provide electrical shielding around each of the pairs of signal vias. The ground vias receive corresponding ground mounting portions.

DETAILED DESCRIPTION OF THE INVENTION

Figure 1:
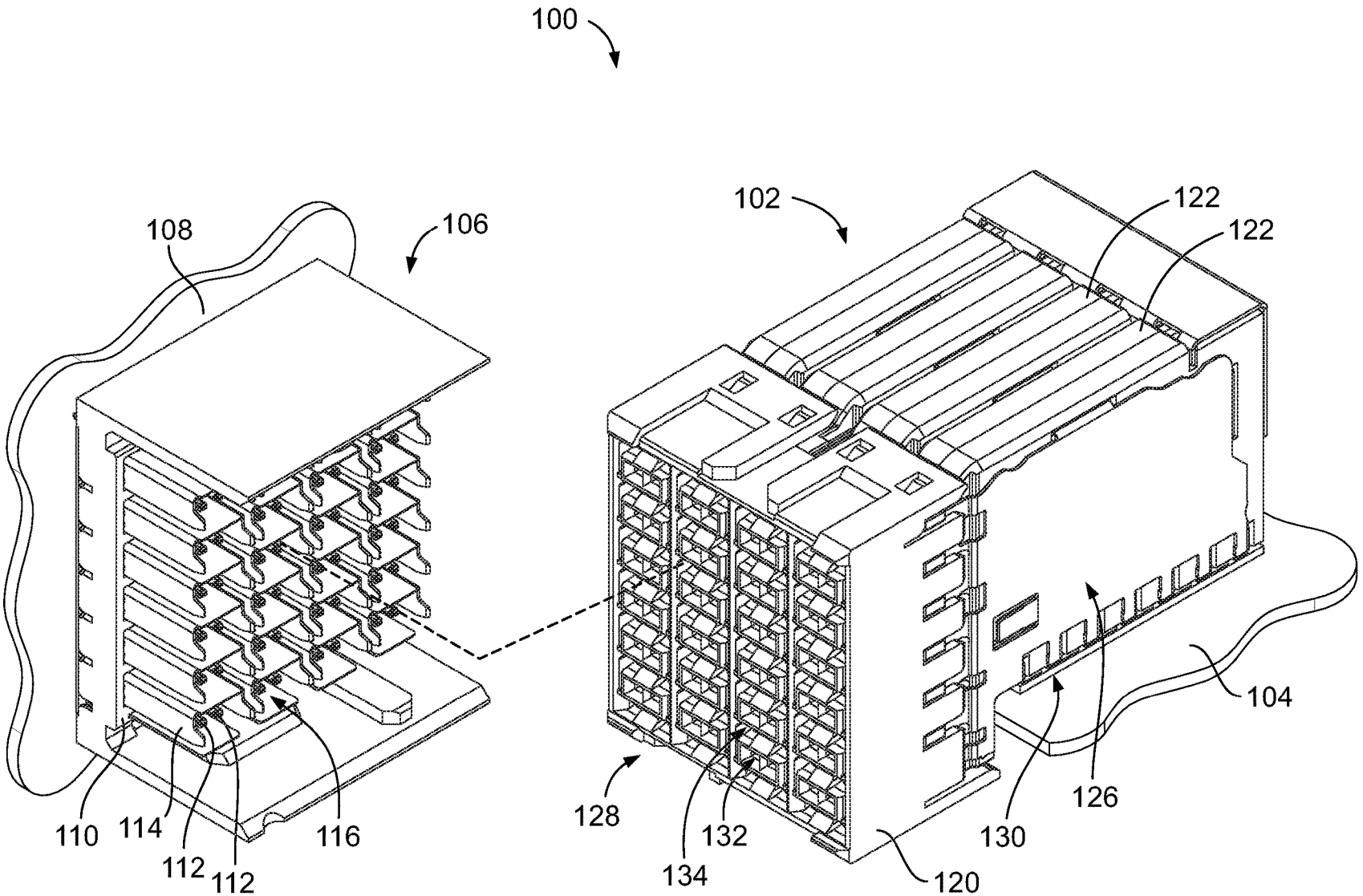
FIG. 1 is a front perspective view of an electrical connector system formed in accordance with an exemplary embodiment.

FIG. 1 is a front perspective view of an electrical connector system 100 formed in accordance with an exemplary embodiment. The connector system 100 includes a first electrical connector 102 configured to be mounted to a printed circuit board (PCB) 104 and a second electrical connector 106 configured to be mounted to a printed circuit board (PCB) 108. In the illustrated embodiment, the electrical connector 106 is a header connector mounted to a backplane circuit board and the electrical connector 102 is a receptacle connector mounted to a daughtercard circuit board; however, various other types of connectors may be used in various embodiments. The receptacle connector may be a right angle connector, a vertical connector or another type of connector.

The electrical connector 106 includes a housing 110 holding a plurality of signal contacts 112 and ground shields 114. The signal contacts 112 may be arranged in pairs 116. Optionally, the signal contacts 112 may be arranged in pairs carrying differential signals; however other signal arrangements are possible in alternative embodiments, such as single-ended applications. Optionally, the pairs 116 of signal contacts 112 may be arranged in columns (pair-in-column signal contacts). Alternatively, the pairs 116 of signal contacts 112 may be arranged in rows (pair-in-row signal contacts).

Each ground shield 114 extends around corresponding signal contacts 112, such as around corresponding pairs 116 of signal contacts 112. The ground shields 114 provide shielding for each pair 116 of signal contacts 112 along substantially the entire lengths of the signal contacts 112. The ground shields 114 may be electrically grounded at the circuit board 108. The ground shields may be electrically grounded at the electrical connector 102. In the illustrated embodiment, the ground shields 114 are C-shaped having three walls extending along three sides of each pair of signal contacts 112. The ground shield 114 adjacent to the pair 116 provides electrical shielding along the fourth, open side of the pair 116. As such, the pairs 116 of signal contacts 112 are circumferentially surrounded on all four sides by the ground shields 114.

The electrical connector 102 includes a housing 120 that holds a plurality of contact modules 122. The contact modules 122 are held in a stacked configuration generally parallel to one another. The contact modules 122 may be loaded into the housing 120 side-by-side in the stacked configuration as a unit or group. Any number of contact modules 122 may be provided in the electrical connector 102. The contact modules 122 each include a plurality of signal contacts (not shown) that define signal paths through the electrical connector 102. The signal contacts are configured to be electrically connected to corresponding signal contacts 112 of the electrical connector 106.

The electrical connector 102 includes a mating end 128, such as at a front of the electrical connector 102, and a mounting end 130, such as at a bottom of the electrical connector 102. In the illustrated embodiment, the mounting end 130 is oriented substantially perpendicular to the mating end 128. The mating and mounting ends 128, 130 may be at different locations other than the front and bottom in alternative embodiments. The signal contacts extend through the electrical connector 102 from the mating end 128 to the mounting end 130 for mounting to the PCB 104.

In an exemplary embodiment, each contact module 122 has a shield structure 126 for providing electrical shielding for the signal contacts. The shield structure is configured to be electrically connected to the ground shield 114 of the electrical connector 106. The shields structure may be ground shields coupled to sides of the contact modules 122. The shield structure 126 may provide shielding from electromagnetic interference (EMI) and/or radio frequency interference (RFI), and may provide shielding from other types of interference as well to better control electrical characteristics, such as impedance, cross-talk, and the like, of the signal contacts. The contact modules 122 provide shielding for each pair of signal contacts along substantially the entire length of the signal contacts between the mating end 128 and the mounting end 130. In an exemplary embodiment, the shield structure 126 is configured to be electrically connected to the mating electrical connector and/or the PCB 104. The shield structure 126 may be electrically connected to the PCB 104 by features, such as grounding pins and/or surface tabs.

The housing 120 includes a plurality of signal contact openings 132 and a plurality of ground contact openings 134 at the mating end 128. The signal contacts are received in corresponding signal contact openings 132. The signal contact openings 132 receive corresponding signal contacts 112 of the electrical connector 106. In the illustrated embodiment, the ground contact openings 134 are C-shaped extending along three sides of the corresponding pair of signal contact openings 132. The ground contact openings 134 receive ground shields 114 of the electrical connector 106. The ground contact openings 134 also receive portions of the shield structure 126 (for example, beams and/or fingers) of the contact modules 122 that mate with the mating ground shields 114 to electrically common the shield structure 126 with the mating electrical connector 106.

Figure 2:
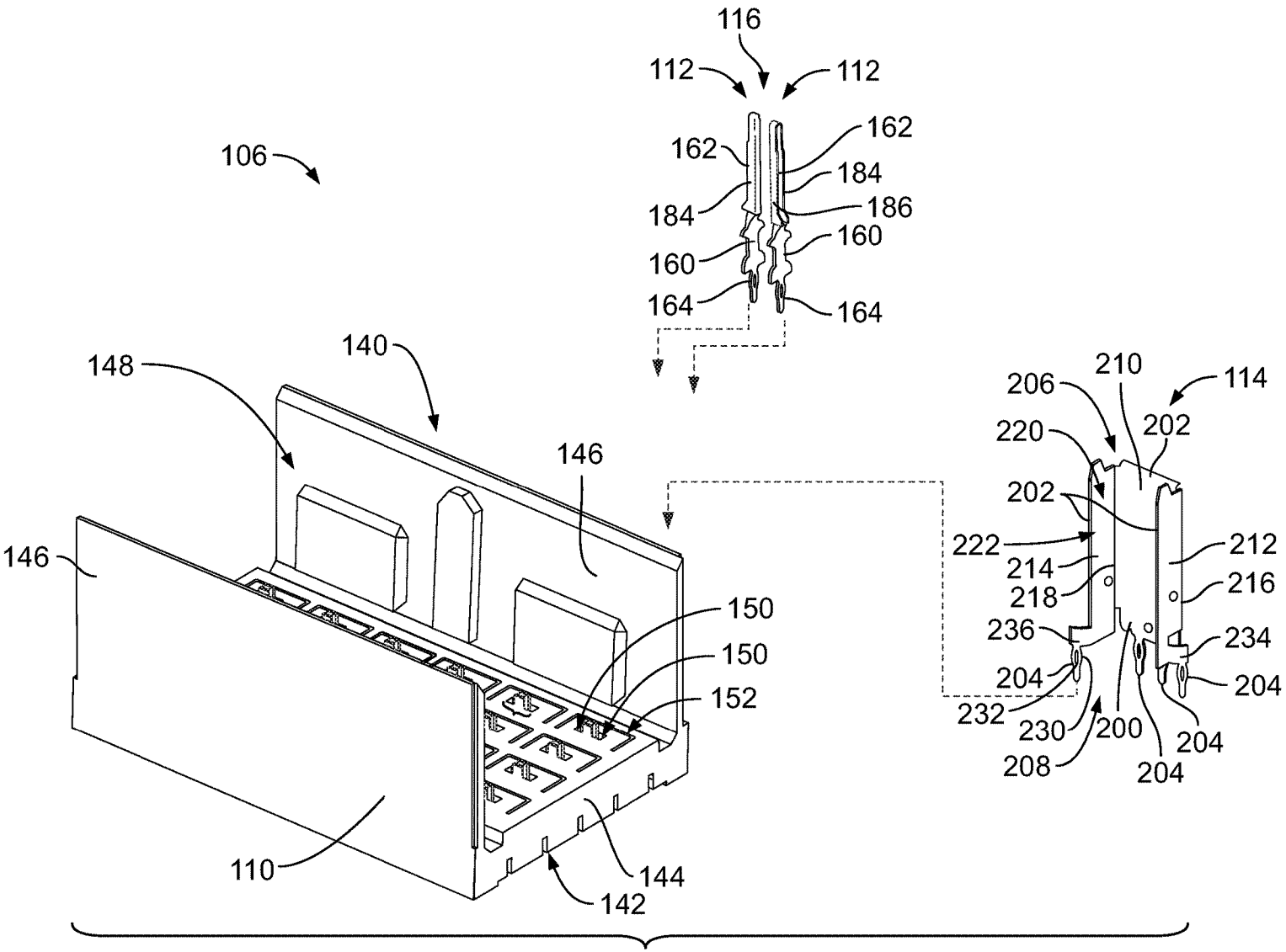
FIG. 2 is an exploded view of an electrical connector of the electrical connector system in accordance with an exemplary embodiment.
Figure 3:
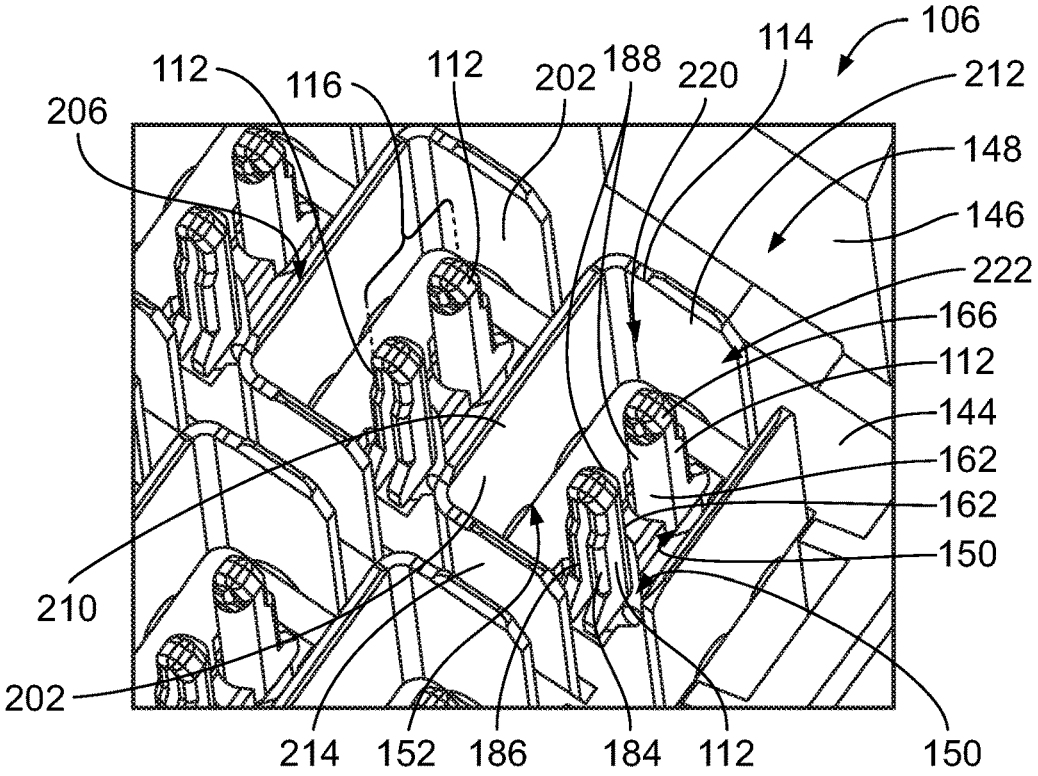
FIG. 3 is a perspective view of a portion of the electrical connector in accordance with an exemplary embodiment.

FIG. 2 is an exploded view of the electrical connector 106 in accordance with an exemplary embodiment. FIG. 3 is a perspective view of a portion of the electrical connector 106 in accordance with an exemplary embodiment. The electrical connector 106 includes the housing 110 holding the signal contacts 112 and the ground shields 114. The housing 110 extends between a mating end 140 and a mounting end 142 configured to be mounted to the PCB 108 (shown in FIG. 1). The housing 110 includes a base wall 144 at the mounting end 142 and shroud walls 146 extending from the base wall 144 to the mating end 140. The base wall 144 and the shroud walls 146 define a cavity 148 configured to receive the electrical connector 102 (shown in FIG. 1). The base wall 144 includes signal contact openings 150 that receive corresponding signal contacts 112 and ground shield openings 152 that receive corresponding ground shields 114. The signal contacts 112 and the ground shields 114 are configured to extend from the base wall 144 into the cavity 148 for mating with the electrical connector 102. The signal contacts 112 and the ground shields 114 are configured to extend from the base wall 144 at the mounting end 142 for termination to the PCB 108.

Figure 4:
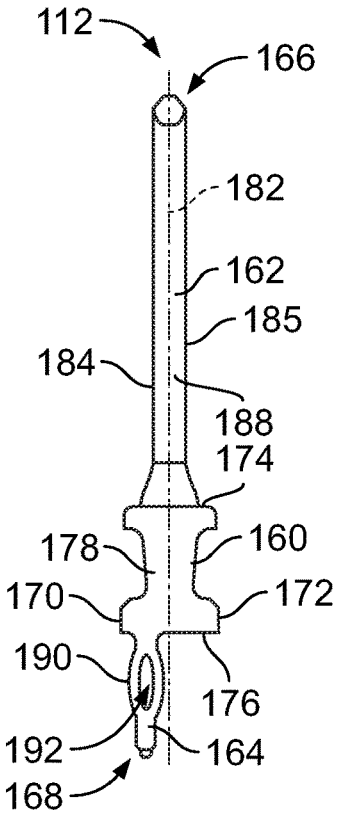
FIG. 4 is a front view of a signal contact of the electrical connector in accordance with an exemplary embodiment.
Figure 5:
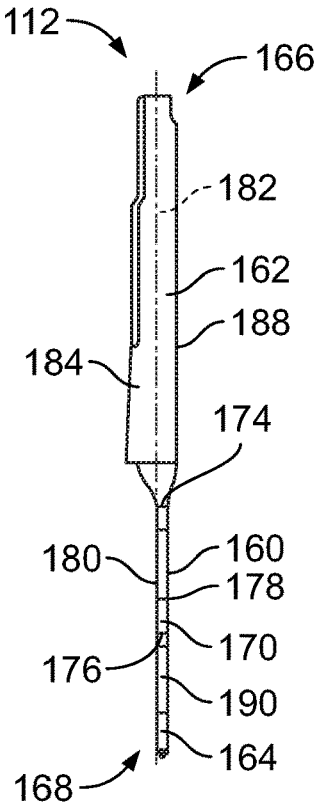
FIG. 5 is a side view of a signal contact of the electrical connector in accordance with an exemplary embodiment.

In an exemplary embodiment, the signal contacts 112 are stamped and formed from a metal sheet or blank. Optionally, each of the signal contacts 112 may be identical; however, different signal contacts 112, such as signal contacts within each pair 116 may have different features, such as mirrored features. With additional reference to FIGS. 4 and 5, which are front and side views, respectively, of the signal contacts 112, each signal contact 112 includes a base 160, a mating pin 162 extending from the base 160 and a signal mounting portion 164 extending from the base 160 opposite the mating pin 162. The base 160 may be held in the signal contact opening 150 by an interference fit. For example, the base 160 may include dimples, tabs or barbs that interfere with the plastic material of the housing 110 to hold the signal contact 112 in the housing 110.

The signal contact 112 extends between a mating end 166 and a mounting end 168. The mating pin 162 is provided at the mating end 166. The signal mounting portion 164 is provided at the mounting end 168 and configured to be terminated to the PCB 108, such as in the signal vias of the PCB 108. The base 160 includes a first edge 170 and a second edge 172 opposite the first edge 170 extending between a top 174 and a bottom 176. The mating pin 162 extends from the top 174 of the base 160. The signal mounting portion 164 extends from the bottom 176 of the base 160. The base 160 has a first side 178 and a second side 180 opposite the first side 178 extending between the top 174 and the bottom 176. In an exemplary embodiment, the signal contacts 112 within each pair 116 are received in corresponding signal contact openings 150 such that the first sides 178 of the bases 160 face each other and the second sides 180 face away from each other. For example, the signal contacts 112 within each pair 116 are inverted 180° relative to each other. Other orientations are possible in alternative embodiments.

The mating pin 162 extends along a mating pin axis 182. In an exemplary embodiment, the mating pin 162 is oriented relative to the base 160 such that the mating pin axis 182 is approximately centered between the first and second edges 170, 172. In an exemplary embodiment, the mating pin 162 is rolled or formed into a pin shape. For example, edges of the mating pin 162 may be folded inward to form a U-shaped pin. In the illustrated embodiment, the mating pin 162 includes a first rail 184 and a second rail 186 with a folded portion 188 between the first rail 184 and the second rail 186. Optionally, the first and second rails 184, 186 may be separated by a gap. The gap may be open at the second side 180. The folded portion 188 may be provided at the first side 178. Optionally, the first and second rails 184, 186 may extend generally parallel to each other with the folded portion 188 connecting therebetween. The folded portion 188 may be curved between the first and second rails 184, 186. In an exemplary embodiment, the mating pin 162 is offset out of the plane of the base 160, such that the mating pin axis 182 is offset relative to the base 160, such as offset from the second side 180. For example, the base 160 may be directly below the folded portion 188 while the first and second rails 184, 186 are offset relative to the base 160.

The signal mounting portion 164 may be stamped and formed with the base 160. In an exemplary embodiment, the signal mounting portion 164 is a compliant pin, such as an eye of the needle pin. The signal mounting portion 164 includes a compliant portion 190, which may be a bulged portion that is wider than other portions of the signal mounting portion 164. The compliant portion 190 may have an opening 192 therethrough allowing the compliant portion 190 to be flexed or squeezed inward when mating to the PCB 108. In an exemplary embodiment, the signal mounting portion 164 is offset from the mating pin axis 182. For example, the mating pin 162 may be approximately centered between the first and second edges 170, 172, whereas the signal mounting portion 164 is positioned closer to the first edge 170 than the second edge 172. Optionally, the signal mounting portion 164 may be positioned at the first edge 170. When the signal contacts 112 within the pair 116 are coupled to the housing 110, the signal contacts 112 are inverted 180° relative to each other such that the signal mounting portions 164 are offset in opposite directions from each other, such as on opposite sides of the mating pin axes 182. In an exemplary embodiment, the compliant portion 190 is in plane with the base 160, such as directly below the bottom 176. In alternative embodiments, the signal mounting portion 164 may be offset out of the plane of the base 160.

With reference back to FIGS. 2 and 3, the ground shield 114 includes a base 200 defined by a plurality of walls 202. The ground shield 114 includes ground mounting portions 204 extending from the base 200. The ground shield 114 extends between a mating end 206 and a mounting end 208. The base 200 is provided at or near the mounting end 208. The ground mounting portions 204 are provided at the mounting end 208 and configured to be terminated to the PCB 108. For example, the ground mounting portions 204 are configured to be received in the ground vias of the PCB 108. The base 200 is configured to be received in the ground shield opening 152 and the base wall 144 of the housing 110. The base 200 may be held in the ground shield opening 152 by an interference fit. For example, the base 200 may include dimples, tabs or barbs that interfere with the plastic material of the housing 110 to hold the ground shield 114 in the housing 110.

In an exemplary embodiment, the ground shield 114 is C-shaped with the walls 202 including an end wall 210, a first side wall 212 and a second side wall 214. The first side wall 212 extends from a first edge 216 of the end wall 210 and the second side wall 214 extends from a second edge 218 of the end wall 210 opposite the first edge 216. The end wall 210, the first side wall 212 and the second side wall 214 form a shield pocket 220 configured to receive a corresponding pair 116 of the signal contacts 112. The walls 202 surround three sides of the corresponding pair 116 of the signal contacts 112 to provide electrical shielding for the pair 116 of signal contacts 112. The ground shield 114 may have other shapes in alternative embodiments. The ground shield 114 has an open side 222 opposite the end wall 210 between the first and second side walls 212, 214. The open side 222 is configured to be closed and shielded by the adjacent ground shield 114 to provide circumferential shielding for the shield pocket 220.

The end wall 210 includes one or more of the ground mounting portions 204. The first side wall 212 includes one or more of the ground mounting portions 204. The second side wall 214 includes one or more of the ground mounting portions 204. Each ground mounting portion 204 may be stamped and formed with the base 200. In an exemplary embodiment, the ground mounting portion 204 is a compliant pin, such as an eye of the needle pin. The ground mounting portion 204 includes a compliant portion 230, which may be a bulged portion that is wider than other portions of the ground mounting portion 204. The compliant portion 230 may have an opening 232 therethrough allowing the compliant portion 230 to be flexed and squeezed inward when mating to the PCB 108. In an exemplary embodiment, the end wall 210 includes a pair of the ground mounting portions 204, which are configured to be arranged in line with the signal contacts 112 of the corresponding pair 116.

In an exemplary embodiment, the first side wall 212 includes a wing 234 configured to be bent out of plane with the first side wall 212. The ground mounting portion 204 extends from the wing 234 and the wing 234 is used to position the ground mounting portion 204 out of the plane of the first side wall 212. In an exemplary embodiment, the second side wall 214 includes a wing 236 configured to be bent out of plane with the second side wall 214. The ground mounting portion 204 extends from the wing 236 and the wing 236 is used to position the ground mounting portion 204 out of the plane of the second side wall 214. Optionally, the wings 234, 236 are shaped differently to offset the ground mounting portions 204 relative to each other. For example, the wing 236 may position the corresponding ground mounting portion 204 further from the end wall 210 and the wing 234 may position the corresponding ground mounting portion 204 closer to the end wall 210.

Figure 6:
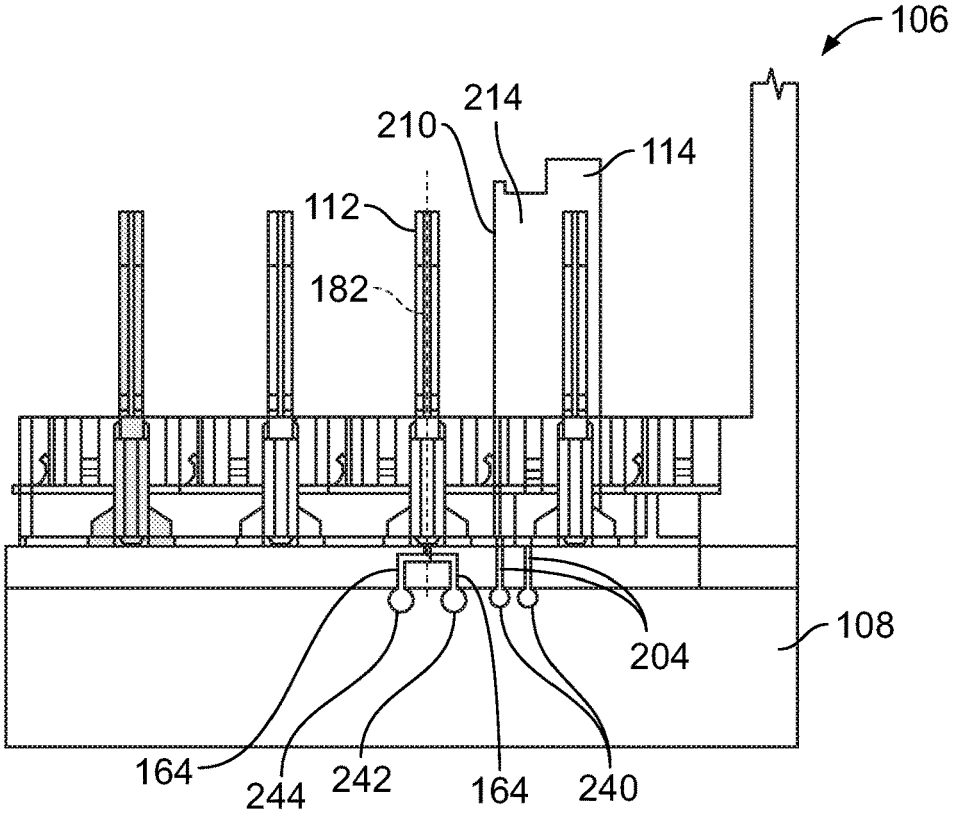
FIG. 6 is a schematic illustration of the electrical connector mounted to a PCB.

FIG. 6 is a schematic illustration of the electrical connector 106 showing the electrical connector 106 mounted to the PCB 108. FIG. 6 illustrates one of the ground shields 114 positioned relative to the corresponding signal contacts 112. FIG. 6 schematically illustrates the ground shield 114 electrically connected to the PCB 108 at multiple nodes 240, such as using multiple ground mounting portions 204, such as ground mounting portions 204 extending from the end wall 210 and extending from the sidewall 214. Other ground shields 114 are removed to illustrate the signal contacts 112.

The signal contacts 112 are schematically illustrated electrically connected to the PCB 108, such as using the signal mounting portions 164. In an exemplary embodiment, the signal mounting portions 164 are offset toward the first edge 170 such that the signal mounting portions 164 are offset from the mating pin axis 182. The illustrated signal contact 112 shows the signal mounting portion 164 electrically connected to the PCB 108 at node 242, noting that the node 242 is offset from the mating pin axis 182. The other signal contact within the pair 116 is configured to be electrically connected to the PCB 108 at node 244. The node 244 is offset from the mating pin axis 182 and is offset from the node 242, such as on the opposite side of the mating pin axis 182. For example, because the signal contacts 112 are inverted 180° relative to each other, the signal mounting portions 164 are offset in different directions when coupled to the PCB 108.

Figure 7:
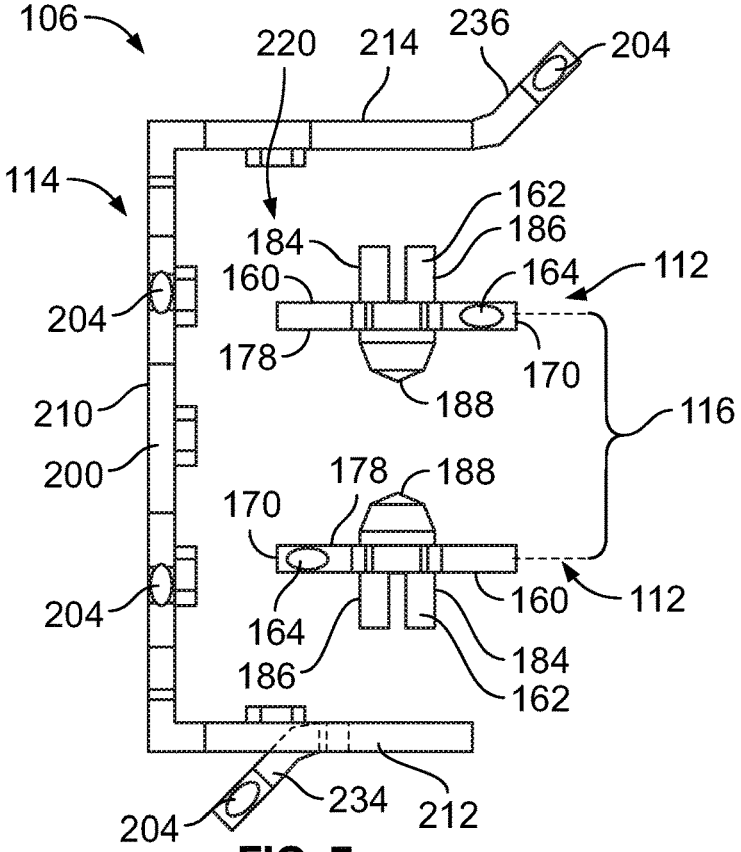
FIG. 7 is an end view of a portion of the electrical connector showing signal contacts and a ground shield in accordance with an exemplary embodiment.

FIG. 7 is an end view of a portion of the electrical connector 106 showing the pair 116 of signal contacts 112 and the corresponding ground shield 114. The signal contacts 112 are positioned in the shield pocket 220 and surrounded by the end wall 210, the first side wall 212 and the second side wall 214. The signal contacts 112 are shown inverted relative to each other with the mating pins 162 facing in opposite directions. For example, the folded portions 188 face each other and the rails 184, 186 face away from each other. The first sides 178 of the bases 160 face each other. In the illustrated embodiment, the signal mounting portions 164 are provided at the first edges 170 of the corresponding bases 160. Because the signal contacts 112 are inverted 180° with respect to each other, the signal mounting portions 164 are offset on opposite sides of the corresponding mating pins 162.

The ground shield 114 surrounds the signal contacts 112. The ground mounting portions 204 extend from the base 200 for termination to the PCB 108. In the illustrated embodiment, the end wall 210 includes two ground mounting portions 204 that are generally aligned with the bases 160 of the pair 116 of signal contacts 112. The wing 234 includes one of the ground mounting portions 204 and the wing 236 includes one of the ground mounting portions 204. Optionally, other portions of the sidewalls 212, 214 may include ground mounting portions 204.

Figure 8:
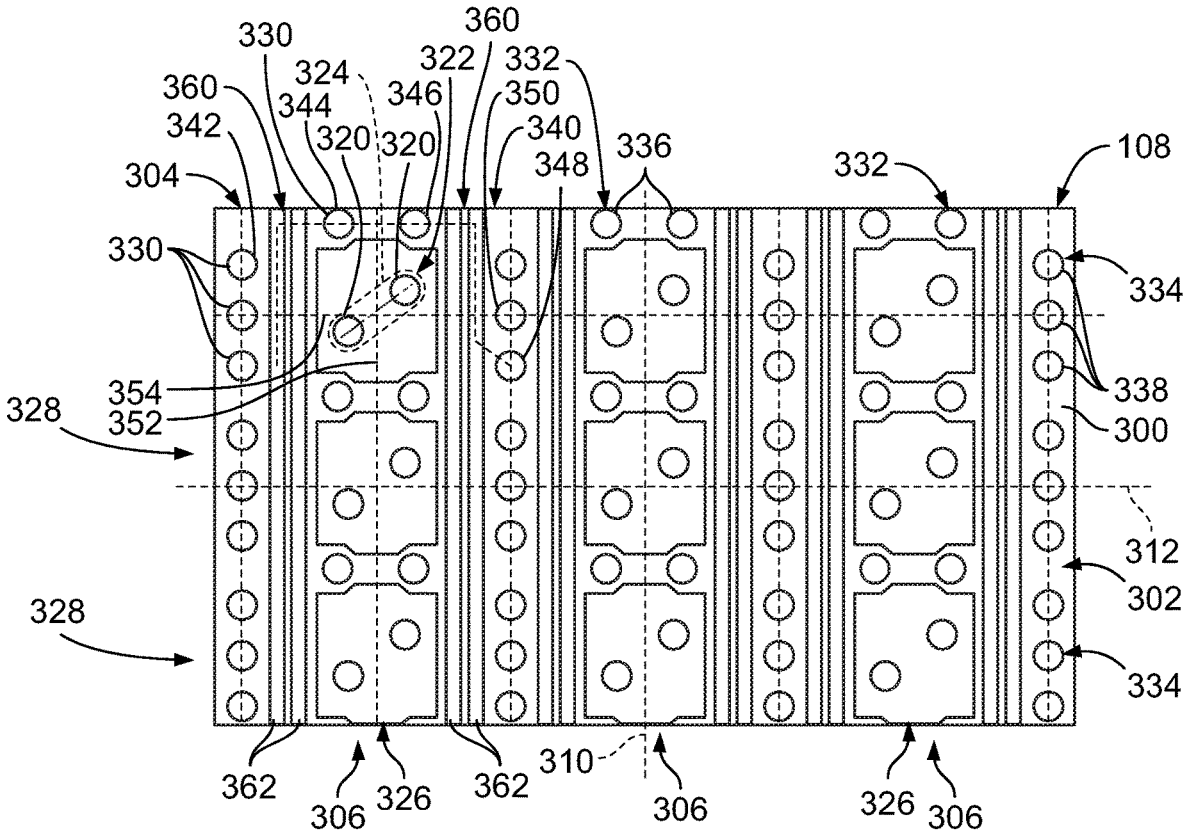
FIG. 8 illustrates the PCB having a PCB connector footprint in accordance with an exemplary embodiment.

FIG. 8 illustrates the PCB 108 in accordance with an exemplary embodiment. The PCB 108 includes a substrate 300 having a plurality of layers. The substrate 300 has a connector surface 302, which may be the top surface, of the PCB 108. The connector surface 302 is configured to face the electrical connector 106 (shown in FIG. 1).

The PCB 108 has a PCB connector footprint 304 (only a portion of which is shown in FIG. 8) on the connector surface 302 defined below the electrical connector 106. The PCB connector footprint 304 is an area generally bounded along the perimeter of the electrical connector 106. The footprint may include vias, traces and the portions of the circuit board around the vias and the traces. The vias and the traces have a layout in the footprint and the traces may extend beyond the footprint. The PCB connector footprint 304 is defined along a longitudinal axis 310 and a lateral axis 312 perpendicular to the longitudinal axis 310. The longitudinal axis 310 extends front-to-back, such as from an edge of the PCB 108. The lateral axis 312 extends side-to-side. The PCB connector footprint 304 has a length along the longitudinal axis 310 and a width along the lateral axis 312.

The PCB 108 has a plurality of PCB column grouping footprints 306 (shown generally by dashed lines, only portions of which are shown in FIG. 8). The PCB column grouping footprints 306 may be stacked together to define the PCB connector footprint 304. For example, the PCB connector footprint 304 is subdivided into PCB column grouping footprints 306 defined below corresponding columns of the ground shields 114 and corresponding signal contacts 112 (shown in FIG. 1) of the electrical connector 106. The PCB column grouping footprints 306 are areas extending generally parallel to the longitudinal axis 310. Each PCB column grouping footprint 306 has a length along the longitudinal axis 310 and a width along the lateral axis 312; however, the lengths and the widths of the footprints 306 may vary.

The PCB 108 has signal vias 320 at least partially through the substrate 300. The signal vias 320 are arranged in pairs 322 arranged along a signal pair axis 324. The number of pairs 322 of signal vias 320 depends on the number of pairs of signal contacts 112 in the electrical connector 106. In various embodiments, each PCB column grouping footprint 306 has a plurality of pairs 322 of signal vias 320. In an exemplary embodiment, the pairs 322 of signal vias 320 are arranged in columns 326 and in rows 328. For example, the pairs 322 of signal vias 320 in the columns 326 are aligned longitudinally along the longitudinal axis 310 and the pairs 322 of signal vias 320 in the rows 328 are aligned laterally along the lateral axis 312.

In an exemplary embodiment, the pairs 322 of signal vias 320 are angled and offset. For example, the signal pair axis 324 is non-parallel to the longitudinal axis 310 and non-parallel to the lateral axis 312. In an exemplary embodiment, the signal pair axis 324 is at a non–45° angle. For example, the signal pair axis 324 intersects the longitudinal axis 310 at a greater angle than the signal pair axis 324 intersects the lateral axis 312 such that the signal pair axis 324 is closer to parallel to the lateral axis 312 than to the longitudinal axis 310. In various embodiments, the signal pair axis 324 is at an angle of between approximately 46° and 60° from the longitudinal axis 310. For example, the signal pair axis 324 may be at an angle of approximately 54° from the longitudinal axis 310. As such, the signal vias 320 have a short and wide orientation without being parallel to the longitudinal axis 310 or parallel to the lateral axis 312. By arranging the signal vias 320 more wide (for example, greater than 45°), the signal vias may be adequately spaced from the ground vias without causing the overall PCB connector footprint 304 to lengthen. The signal pair axis 324 may be at other angles in alternative embodiments. The orientation of the signal vias 320 relative to ground vias 330 may enhance the signal integrity of the system, such as by reducing cross-talk. For example, having the signal vias 320 angled rather than parallel to the lateral axis 312, allows for more spacing between the signal vias 320 and at least some of the ground vias 330 to enhance signal integrity.

The PCB 108 includes ground vias 330 at least partially through the substrate 300. The ground vias 330 are arranged around each of the pairs 322 of signal vias 320 to provide termination points of the ground mounting portions 204 (shown in FIG. 2) and electrical shielding around each of the pairs 322 of signal vias 320. The ground vias 330 are arranged in columns 332 (for example, parallel to the longitudinal axis 310) and in rows 334 (for example, parallel to the lateral axis 312) with the signal vias 320. For example, the ground vias 330 may include both in-column ground vias 336 and in-row ground vias 338. The in-column ground vias 336 are arranged in the columns 332 with the columns 326 of signal vias 320. The in-row ground vias 338 are arranged in the rows 334 with the rows 328 of signal vias 320. The ground vias 330 are positioned generally in line with the signal vias 320; however, may be designed with slight offsets, such as for ease of manufacture or signal integrity control. Other positions are possible in alternative embodiments.

In an exemplary embodiment, the ground vias 330 are arranged in via sets 340 corresponding to the associated ground shield 114. For example, each via set 340 includes a first ground via 342 receiving the ground mounting portion 204 extending from the first side wall 212, a second ground via 344 receiving one of the ground mounting portions 204 extending from the end wall 210, a third ground via 346 receiving the other ground mounting portion 204 extending from the end wall 210, and a fourth ground via 348 receiving the ground mounting portion 204 extending from the second side wall 214. The second and third ground vias 344, 346 define the in-column ground vias 336. The first and fourth ground vias 342, 348 define the in-row ground vias 338, being arranged at different sides of the corresponding pair 322 of signal vias 320. In an exemplary embodiment, due to the shape of the wings 234, 236 of the ground shield 114, the ground mounting portions 204 of adjacent ground shields 114 may be arranged in line with each other, such as defining the in-row ground vias 338.

Additional ground vias 330 may be provided around the pairs 322 of signal vias 320. For example, signal integrity ground vias 350 may be provided in the rows 334 to provide additional shielding between the pairs 322 of the signal vias 320 and/or between the associated traces. In the illustrated embodiment, the signal integrity ground vias 350 are provided between first and fourth ground vias 342, 348 of different ground shields 114. Optionally, the signal integrity ground vias 350 may not receive any mounting portions from the electrical connector 106, but rather may remain open or may be filled with conductive material.

In an exemplary embodiment, the signal vias 320 of each pair 322 are offset on opposite sides of a longitudinal centerline 352 of the PCB column grouping footprint 306. For example, the signal contacts 112 are arranged side-by-side within the shield pocket 220 defined by the ground shield 114 on opposite sides of the longitudinal centerline 352. In an exemplary embodiment, the signal vias 320 of each pair 322 are offset on opposite sides of a pair centerline 354 of the corresponding pair 322. For example, because the signal mounting portions 164 are offset in different directions when the signal contacts 112 are arranged in the electrical connector 106, the signal vias 320 are offset to accommodate the offset signal mounting portions 164. Optionally, the pair centerline 354 may be aligned with the mating pin axes 182 of the pair of signal contacts 112, but because the signal mounting portions 164 are offset with respect to the mating pin axes 182, the signal vias 320 are staggered on opposite sides of the pair centerline 354.

In an exemplary embodiment, the PCB connector footprint 304 includes trace routing areas 360 between the columns 326 of signal vias 320 and the in-row ground vias 338 for routing signal traces 362 connected to corresponding signal vias 320. Optionally, the trace routing areas 360 may flank both sides of the columns 326 of signal vias 320. The in-row ground vias 338 are configured to be positioned between different trace routing areas 360, which may provide electrical shielding between different signal traces 362. The signal vias 320 and the ground vias 330 are tightly arranged such that relatively large gaps are provided for the trace routing areas 360.

Figure 9:
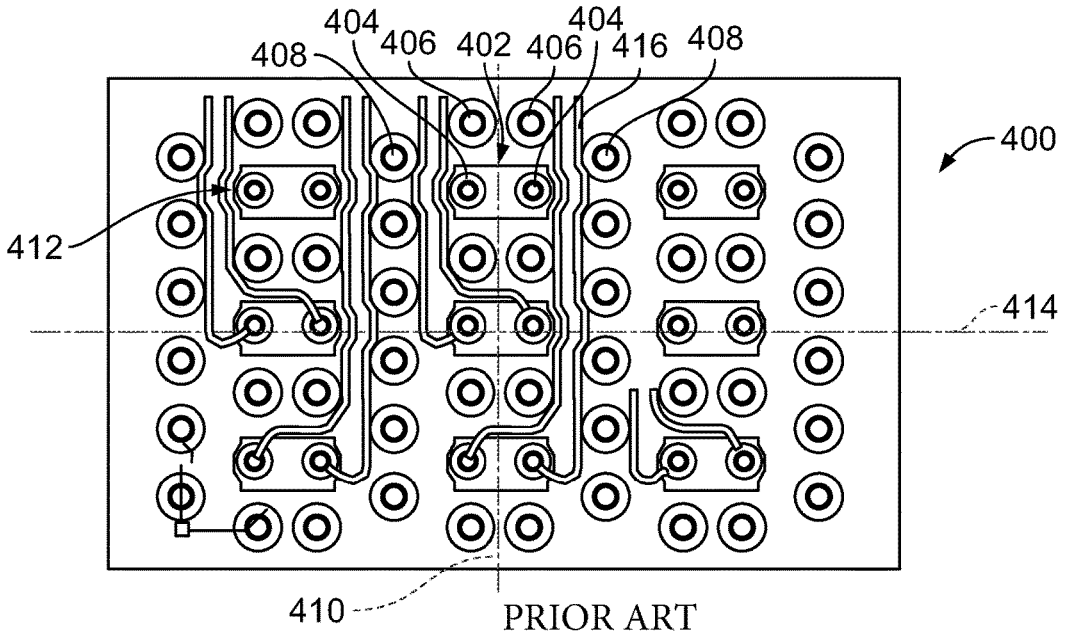
PRIOR ART FIG. 9
FIG. 9 illustrates a prior art printed circuit board in accordance with an embodiment.

FIG. 9 illustrates a prior art printed circuit board 400 in accordance with an embodiment. The printed circuit board 400 includes pairs 402 of signal vias 404 and ground vias 406 surrounding the signal vias 404. The ground vias 406 and the signal vias 404 are arranged in columns 408. The columns 408 are parallel to a longitudinal axis 410. The pairs of signal vias 404 are arranged in rows 412 parallel to a lateral axis 414. Because the signal vias 404 are arranged parallel to the lateral axis 414, the widths of the footprints are increased as compared to the arrangement of the PCB 108 shown in FIG. 8.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f) unless and until such claim limitations expressly use the phrase "means for" followed by a statement of function void of further structure.

What is claimed is:

1. A printed circuit board (PCB) for an electrical connector having signal contacts and ground contacts extending from a mounting end of the electrical connector, the PCB comprising:

a substrate having a plurality of layers, the substrate having a connector surface configured to face the electrical connector and a PCB connector footprint on the connector surface defined below a footprint of the electrical connector, the PCB connector footprint being an area defined along a longitudinal axis and a lateral axis perpendicular to the longitudinal axis, the PCB connector footprint being subdivided into PCB column grouping footprints generally arranged in columns parallel to the longitudinal axis;

signal vias at least partially through the substrate, the signal vias being arranged in pairs arranged along a signal pair axis with a plurality of pairs of signal vias in each PCB column grouping footprint, the signal pair axis being non-parallel to the longitudinal axis, the pairs of signal vias being aligned in the corresponding columns parallel to the longitudinal axis, the pairs of signal vias being arranged in corresponding rows parallel to the lateral axis, the signal pair axis being non-parallel to the lateral axis, the signal pair axis being non-parallel to the longitudinal axis, wherein the signal pair axis intersects the longitudinal axis at a greater angle than the signal pair axis intersects the lateral axis; and ground vias at least partially through the substrate, the ground vias being arranged around each of the pairs of signal vias to provide electrical shielding around each of the pairs of signal vias, wherein at least one ground via is arranged between adjacent pairs of signal vias within the PCB column grouping footprints and wherein at least one ground via is arranged between adjacent pairs of signal vias in adjacent PCB column grouping footprints.

2. The PCB of claim 1, wherein the ground vias include column separating ground vias centered between adjacent columns of the signal vias.

3. The PCB of claim 1, wherein the ground vias are centered between the pairs of signal vias within the same column and the ground vias are centered between the pairs of signal vias within the same row.

4. The PCB of claim 1, wherein the signal pair axis is a non−45° angle relative to the longitudinal axis.

5. The PCB of claim 1, wherein the signal pair axis is between 46° and 60° from the longitudinal axis.

6. The PCB of claim 1, wherein each pair of signal vias includes a first signal via and a second signal via, the first and second signal vias being offset on opposite sides of the longitudinal centerline of the PCB column grouping footprint.

7. The PCB of claim 1, wherein the PCB connector footprint includes trace routing areas between signal vias and ground vias for routing signal traces connected to corresponding signal vias.

8. The PCB of claim 1, wherein adjacent PCB column grouping footprints have a shared interface, the ground vias include ground vias in-row with the signal vias between adjacent pairs of signal vias, the row ground vias being arranged along the shared interfaces.

9. An electrical connector system comprising:

an electrical connector having a housing holding signal contacts and ground shields, the signal contacts being arranged in pairs carrying differential signals, the signal contacts having signal mounting portions extending from a mounting end of the housing, the ground shields having ground mounting portions extending from the mounting end of the housing, wherein each signal contact includes a base having first and second edges extending between a top and a bottom of the base, the signal mounting portions extending from the bottom of the base, and each signal contact includes a mating pin extending from the top of the base centered between the first and second edges, the signal mounting portions being offset from a center of the base closer to the first edge; and a printed circuit board (PCB) comprising a substrate having a connector surface facing the electrical connector and a PCB connector footprint on the connector surface defined below a footprint of the electrical connector, the PCB connector footprint being an area defined along a longitudinal axis and a lateral axis perpendicular to the longitudinal axis, the PCB connector footprint being subdivided into PCB column grouping footprints, the PCB column grouping footprints being areas extending generally parallel to the longitudinal axis, the PCB comprising signal vias arranged in pairs arranged along a corresponding signal pair axis, the signal vias receiving corresponding signal mounting portions, a plurality of pairs of signal vias being arranged in each PCB column grouping footprint, the signal pair axis being non-parallel to the longitudinal axis, the signal pair axis being non-parallel to the lateral axis, the signal pair axis intersecting the longitudinal axis at a greater angle than the signal pair axis intersects the lateral axis, the PCB comprising ground vias arranged around each of the pairs of signal vias to provide electrical shielding around each of the pairs of signal vias, the ground vias receiving corresponding ground mounting portions.

10. The electrical connector system of claim 9, wherein the signal contacts include mating pins opposite the signal mounting portions, the mating pins extending along a pin axis, the signal mounting portions being longitudinally offset from the pin axis and being laterally offset from the pin axis.

11. The electrical connector system of claim 9, wherein the signal contacts within the pair are inverted such that the first edges face in opposite directions.

12. The electrical connector system of claim 9, wherein the signal pair axis is between 46° and 60° from the longitudinal axis.

13. The electrical connector system of claim 9, wherein each pair of signal vias includes a first signal via and a second signal via, the first and second signal vias being offset on opposite sides of the longitudinal centerline of the PCB column grouping footprint.

14. The electrical connector system of claim 9, wherein the PCB connector footprint includes trace routing areas between signal vias and ground vias for routing signal traces connected to corresponding signal vias.

15. The electrical connector system of claim 9, wherein the signal pair axis intersects the longitudinal axis at a greater angle than the signal pair axis intersects the lateral axis.

16. An electrical connector system comprising:

an electrical connector having a housing including a base wall and shroud walls defining a cavity configured to receive a mating electrical connector, the base wall having signal channels and shield channels therethrough, the base wall having a mounting end, the housing holding signal contacts in corresponding signal channels and holding ground shields in corresponding shield channels, the signal contacts being arranged in pairs carrying differential signals, the signal contacts having mating ends received in the cavity for mating with the mating electrical connector, the signal contacts having signal mounting portions extending from a mounting end of the housing, the ground shields having an end wall, a first side wall extending from a first edge of the end wall and a second side wall extending from a second edge of the end wall, the end wall, the first side wall and the second side wall forming a shield pocket receiving a corresponding pair of the signal contacts and surrounding three sides of the corresponding pair of signal contacts to provide electrical shielding for the pair of signal contacts, the ground shields having ground mounting portions extending from the mounting end of the housing; and a printed circuit board (PCB) comprising a substrate having a connector surface facing the electrical connector and a PCB connector footprint on the connector surface defined below a footprint of the electrical connector, the PCB connector footprint being an area defined along a longitudinal axis and a lateral axis perpendicular to the longitudinal axis, the PCB connector footprint being subdivided into PCB column grouping footprints, the PCB column grouping footprints being areas extending generally parallel to the longitudinal axis, the PCB comprising signal vias arranged in pairs arranged along a corresponding signal pair axis, the signal vias receiving corresponding signal mounting portions, a plurality of pairs of signal vias being arranged in each PCB column grouping footprint, the signal pair axis being non-parallel to the longitudinal axis, the signal pair axis being non-parallel to the lateral axis, wherein the signal pair axis intersects the longitudinal axis at a greater angle than the signal pair axis intersects the lateral axis, the PCB comprising ground vias arranged around each of the pairs of signal vias to provide electrical shielding around each of the pairs of signal vias, the ground vias receiving corresponding ground mounting portions.

17. The electrical connector system of claim 16, wherein the ground mounting portions include a first ground mounting portion, a second ground mounting portion and a third ground mounting portion, the first ground mounting portion extending from the first side wall, the second ground mounting portion extending from the second side wall, the third ground mounting portion extending from the end wall, the third ground mounting portion being arranged in-column with the signal mounting portions of the corresponding pair of signal contacts, the first mounting portion being aligned in-column with the second mounting portion of the adjacent ground shield on a first side thereof, the second mounting portion being aligned in-column with the first mounting portion of the adjacent ground shield on a second side thereof.

18. The electrical connector system of claim 16, wherein the signal contacts include mating pins opposite the signal mounting portions, the mating pins extending along a pin axis, the signal mounting portions being longitudinally offset from the pin axis and being laterally offset from the pin axis.

19. The electrical connector system of claim 16, wherein the signal pair axis is between 46° and 60° from the longitudinal axis.

20. The electrical connector system of claim 16, wherein each signal contact includes a base having first and second edges extending between a top and a bottom of the base, the signal mounting portions extending from the bottom of the base, and each signal contact includes a mating pin extending from the top of the base centered between the first and second edges, the signal mounting portions being offset from a center of the base closer to the first edge.

* * * * *